United States Patent [19]

Jepson

[11] 4,181,306

[45] Jan. 1, 1980

[54] GOLF CLUB AND FACE PLATE THEREFOR

[76] Inventor: Harold C. Jepson, 2014 Ellen Ave., San Jose, Calif. 95125

[21] Appl. No.: 877,098

[22] Filed: Feb. 13, 1978

[51] Int. Cl.[2] ..... A63B 53/04

[52] U.S. Cl. ..... 273/173

[58] Field of Search ..... 273/77 R, 78, 167 J, 273/173

[56] References Cited

U.S. PATENT DOCUMENTS

| | | | |
|---|---|---|---|
| 1,423,341 | 7/1922 | Lippincott | 273/173 |
| 3,567,228 | 3/1971 | Lynn | 273/173 X |
| 3,975,023 | 8/1976 | Inamori | 273/173 |

FOREIGN PATENT DOCUMENTS

| | | | |
|---|---|---|---|
| 692134 | 6/1940 | Fed. Rep. of Germany | 273/173 |
| 1062796 | 3/1967 | United Kingdom | 273/167 J |

OTHER PUBLICATIONS

"Golf World"; Oct. 27, 1970; p. 22.

*Primary Examiner*—Richard J. Apley
*Attorney, Agent, or Firm*—John J. Leavitt

[57] ABSTRACT

Presented is a golf club having a face plate fabricated from extremely hard and durable sodium-aluminum silicate material having the formula $NaAlSi_2O_6$ and being harder than conventional synthetic resinous materials used for face plates e.g., a hardness factor in the order of 7.5 mohs.

3 Claims, 5 Drawing Figures

GOLF CLUB AND FACE PLATE THEREFOR

BACKGROUND OF THE INVENTION

1. Field of the Invention.

This invention relates to golf clubs, and particularly to face plates for golf clubs fabricated from exceedingly hard materials.

2. Description of the Prior Art.

Golf club heads have been fabricated from many different types of materials including wood, metal, synthetic resinous materials, molded from single synthetic resinous materials or combinations thereof, some even including fine comminuted or fibrous material embedded in the synthetic resinous material to provide additional strength. All of these various conventional materials have different degrees of hardness and therefore different degrees of compressibility upon impact with a golf ball.

It is generally known that the distance that a golf ball travels when hit by a club head is determined by many different factors. One of these factors is the degree of compressibility of the golf ball upon impact with the club face. Golf ball manufacturing procedures incorporate limits of resilience or "bounce" in the golf ball. One method of testing the resilience or "bounce" of a golf ball is to permit golf balls as they are manufactured to fall a predetermined distance onto a hard surface. The height to which a ball bounces is noted and balls that bounce higher than a predetermined height are excluded from distribution through commercial channels.

Another factor that controls the distance that a golf ball travels when hit by a club is the hardness of the face of the golf club, or in clubs without a face plate, the hardness of the wood from which the club head is formed. In general, the greater the hardness of the face plate the greater will be the compressibility of the golf ball when it is hit, and the greater the compressibility of the golf ball the greater will be the distance travelled by the ball. Accordingly, it is one of the objects of the present invention to fabricate a face plate for a golf club from a material that possesses a hardness factor greater than any known materials heretofore used for this purpose.

Face plates for golf clubs have been fabricated from metal, synthetic resinous materials and wood. To my knowledge a face plate for a golf club has never been fabricated from a naturally occurring material. Therefore, a still further object of the invention is the provision of a face plate for a golf club fabricated from a naturally occurring mineral material.

It has been found that a sodium-aluminum silicate material occurring in nature as a mineral possesses a hardness exceeding any of the known materials conventionally used for golf club face plates. Accordingly, still another object of the invention is the provision of a face plate for a golf club fabricated from sodium-aluminum silicate ($NaAlSi_2O_6$).

This combination of minerals is commonly known as jade or jadeite or nephrite. Accordingly, a still further object of the invention is the provision of a golf club face plate fabricated from a natural jade or jade-like stone having a hardness characteristic of about 7.5 mohs.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the golf club and face plate of the invention comprises a golf club head preferably fabricated from a hard wood such as persimmon or other hard woods that occur naturally and which has attached to its striking face an insert or face plate fabricated from jade, jadeite, or a jade-like stone. In one aspect of the invention, it is contemplated that jade face plates or inserts will be fabricated as an article of manufacture for inclusion in existing clubs. In another aspect, it is contemplated that the club head will be factory-fabricated to receive a jade face plate.

DESCRIPTION OF THE PREFERRED EMBODIMENT

In terms of greater detail, the folf club of the invention comprises a golf club head designated generally by the numeral 2, preferably fabricated from a hard wood in a conventional or classic shape or configuration for such golf clubs commonly known as "woods". The head 2 is formed with a shank 3 adapted to be permanently attached to shaft 4, the upper end of the shaft (not shown) being provided with a conventional grip, also not shown.

Figure 1:
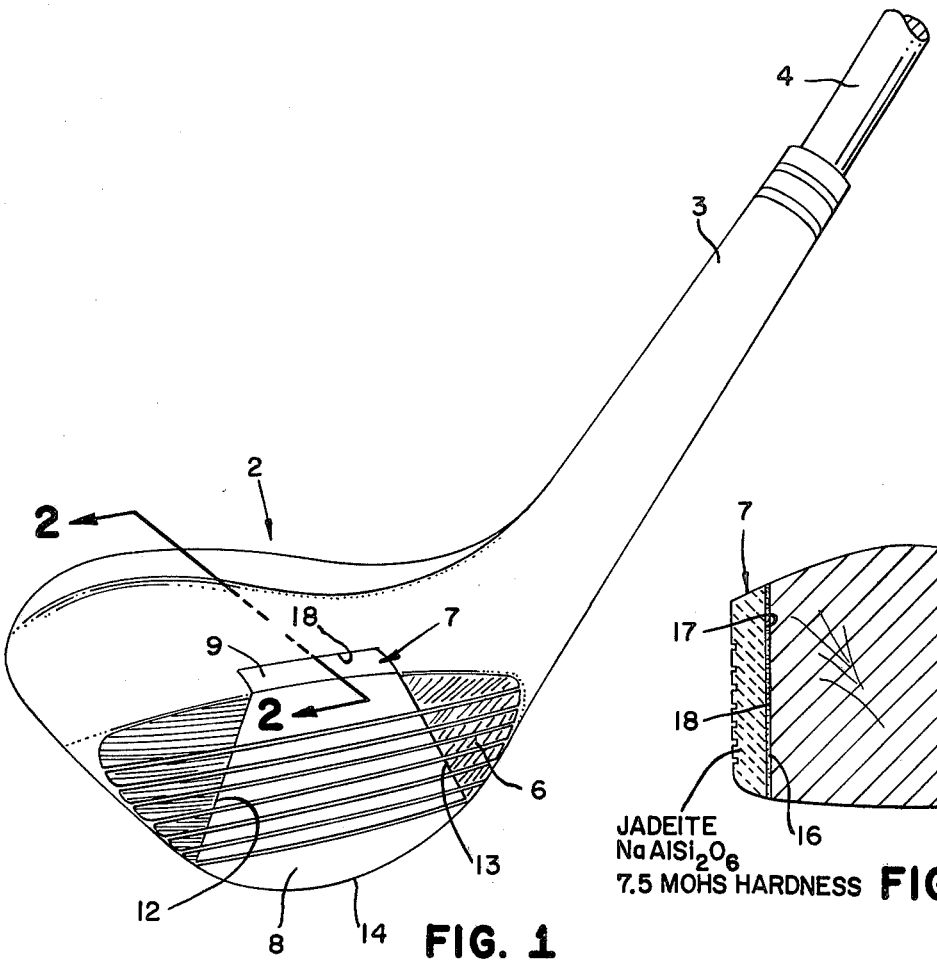
FIG. 1 is a perspective view showing a golf club fabricated with a jade face plate. A portion of the shaft is broken away to reduce the size of the figure.
Figure 2:
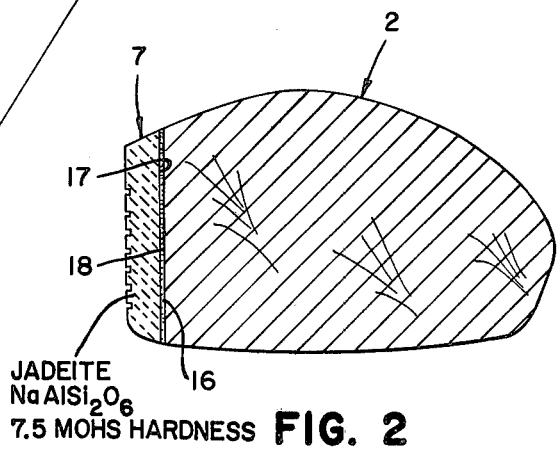
FIG. 2 is a vertical cross-sectional view taken in the plane indicated by the line 2—2 in FIG. 1.

Embodied in the face 6 of the golf club head in an appropriate recess therein is a face plate or insert 7 having face 8 that lies flush with the face 6 of the club head in which it is embedded and which is formed in a conventional configuration including a relatively narrow upper edge portion 9 and diverging side edges 12 and 13 joined at their lower ends by a bottom edge 14. As indicated in FIGS. 1 and 2, the face 6 of the club head and the surface 8 of the insert are provided with horizontally extending grooves that cooperate to minimize slippage between the surface 8 and a golf ball upon impact therebetween. It has been found that the insert 7 may be permanently attached to the face of the golf club 2 by applying a thin layer 16 of adhesive to the back side 17 of the insert so that a strong and permanent bond is provided between the insert and the associated recessed surface 18 of the club head.

As discussed above, jade or jadeite, or jade-like stone that occurs naturally as a mineral is extremely hard and tough and resistant to cracking or chipping. It is also beautiful in appearance and its beauty may be enhanced by appropriate polishing and buffing techniques. Accordingly, a club head or golf club is provided that is not only beautiful in its aesthetic characteristics but which also provides a face plate that is exceedingly hard, in most instances harder than the wood to which it is attached or other materials that might be substituted, to thus provide an increased golf ball driving capability not achieved with other golf club face plates or inserts.

Figure 3A:
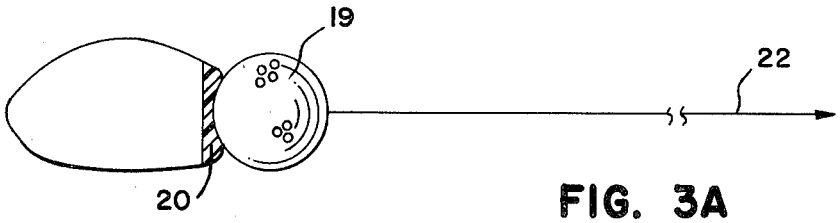
FIG. 3A is a schematic view illustrating the relative compressibility of a synthetic resinous face plate as compared with other materials such as metal and jade.
Figure 3B:
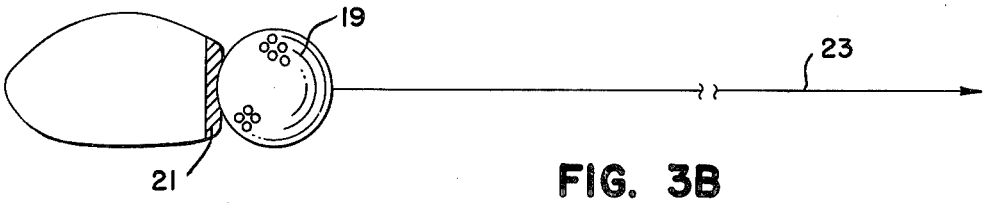
FIG. 3B is a view similar to FIG. 3A and showing schematically the relative compressibility of a metal face plate or insert in relation to synthetic resinous material and jade.
Figure 3C:
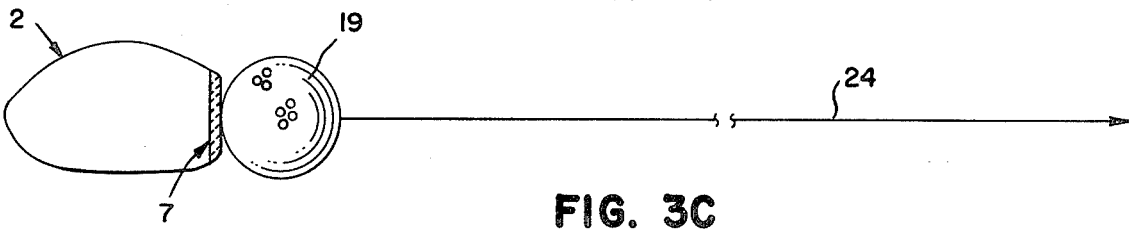
FIG. 3C is a similar schematic view illustrating the relative incompressibility of jade as compared with synthetic resin and metal face plates.

FIGS. 3A through 3C are schematic views illustrating in exaggerated form for clarity the relative compressibility of synthetic resinous materials frequently used for face plates, or metal inserts which are frequently substituted for synthetic resinous materials, and a jadeite or jade stone face plate according to this invention which possesses a hardness factor greater than either synthetic resinous materials or metal. It should be understood that the degree of compressibility of the golf ball 19 in each of these figures and the face plates illustrated therein and numbered 20, 21 and 7, respectively, is not dimensionally accurate, the illustrations being exaggerated for comparative purposes.

Referring to FIG. 3A it will be seen that because of the degree of compressibility of the synthetic resinous face plate there shown, the golf ball will be compressed to a lesser degree than if it were struck by a harder surface and therefore the distance the ball will travel will be less, as indicated by line 22.

Referring to FIG. 3B it will be seen that since metal is harder than synthetic resinous materials, its compressibility is less, thus imparting greater compressibility on the ball 19 with the result that the ball will fly farther as indicated by the line 23.

In like manner, since jade or jadeite has a greater hardness factor than metal it is practically incompressible, thus resulting in all of the compressibility being transferred to the ball with the result that the ball will travel farther as a result of a given impact as indicated by the line 24.

Having thus described the invention, what is claimed to be new and novel and sought to be protected by Letters Patent of the United States is as follows:

1. In combination, a golf club including a head having a golf ball striking face thereon, and a face plate inserted in said golf ball striking face, said face plate being wholly formed from a naturally occurring mineral material having a hardness factor of 7.5. mohs.

2. The combination according to claim 1, in which said naturally occurring mineral material comprises sodium-aluminum silicate having the chemical formula $NaAlSi_2O_6$.

3. The combination according to claim 1 in which said club head is fabricated from wood and said face plate is formed from jadeite.

* * * * *